US008002170B2

(12) United States Patent
Dixon-Garrett et al.

(10) Patent No.: US 8,002,170 B2
(45) Date of Patent: Aug. 23, 2011

(54) DUAL-OVENABLE CONTAINER FORMED OF A PAPER-BASED LAMINATE

(75) Inventors: Sabrina Dixon-Garrett, Bennettsville, SC (US); Elizabeth Rhue, Columbia, SC (US)

(73) Assignee: Sonoco Development, Inc., Hartsville, SC (US)

( * ) Notice: Subject to any disclaimer, the term of this patent is extended or adjusted under 35 U.S.C. 154(b) by 260 days.

(21) Appl. No.: 12/179,626

(22) Filed: Jul. 25, 2008

(65) Prior Publication Data

US 2010/0019021 A1 Jan. 28, 2010

(51) Int. Cl.
*B65D 3/22* (2006.01)
*B32B 1/02* (2006.01)

(52) U.S. Cl. ..... 229/5.84; 229/4.5; 229/903

(58) Field of Classification Search ..... 229/5.81, 229/5.84, 4.5, 903
See application file for complete search history.

(56) References Cited

U.S. PATENT DOCUMENTS

| | | | | |
|---|---|---|---|---|
| 1,836,001 | A | 12/1931 | Angell | |
| 3,106,327 | A | 10/1963 | Karl | |
| 3,336,847 | A | 8/1967 | Durat | |
| 3,958,501 | A | 5/1976 | Richards | |
| 4,525,396 | A * | 6/1985 | Takasa et al. | 229/4.5 |
| 4,692,132 | A * | 9/1987 | Ikushima et al. | 229/4.5 |
| 4,720,039 | A * | 1/1988 | Nishiguchi | 229/198.3 |
| 4,760,949 | A * | 8/1988 | Elias | 229/4.5 |
| 4,900,594 | A | 2/1990 | Quick et al. | |
| 5,002,833 | A | 3/1991 | Kinsey, Jr. et al. | |
| 5,494,716 | A | 2/1996 | Seung et al. | |
| 5,573,693 | A | 11/1996 | Lorence et al. | |
| 5,843,545 | A | 12/1998 | Prince | |
| 5,935,664 | A * | 8/1999 | Claytor et al. | 428/34.2 |
| 5,942,295 | A | 8/1999 | Adur et al. | |
| 5,968,647 | A | 10/1999 | Adur et al. | |
| 5,981,011 | A | 11/1999 | Overcash et al. | |
| 6,007,902 | A | 12/1999 | Adur et al. | |
| 6,068,897 | A | 5/2000 | Adur et al. | |
| 6,074,733 | A * | 6/2000 | Falat | 428/219 |
| 6,291,075 | B1 | 9/2001 | Zhang et al. | |
| 6,307,192 | B1 | 10/2001 | Ulfstedt et al. | |

(Continued)

FOREIGN PATENT DOCUMENTS

| | | | |
|---|---|---|---|
| EP | 0 995 587 | A1 | 4/2000 |
| GB | 2 343 438 | A | 5/2000 |
| WO | WO 03/026892 | A1 | 4/2003 |

(Continued)

OTHER PUBLICATIONS

European Search Report for EP 09 25 1098 completed Jun. 26, 2009.

(Continued)

*Primary Examiner* — Gary E Elkins
(74) *Attorney, Agent, or Firm* — Alston & Bird LLP

(57) ABSTRACT

A dual-ovenable container is formed from a blank of laminate material that includes a paperboard layer sandwiched between outer heat-sealable layers of amorphous polyester or heat-sealable cellophane. The blank is wrapped into a tubular or conical configuration and opposite edges of the blank form a lap joint at which the edges are heat-sealed together to form a container body. End closures can then be applied to the ends of the container body. The laminate is heat-sealable to itself, is able to withstand heating/cooking conditions in both conventional and microwave ovens, and has a low oxygen permeability. The edge of the blank exposed to contents of the container can be wrapped by a sideseam tape in order to protect the edge.

8 Claims, 1 Drawing Sheet

U.S. PATENT DOCUMENTS

| | | | | |
|---|---|---|---|---|
| 6,787,205 | B1 | 9/2004 | Aho et al. | |
| 6,818,151 | B2 * | 11/2004 | Yang et al. | 428/34.2 |
| 2004/0052987 | A1 | 3/2004 | Shetty et al. | |
| 2004/0121049 | A1 | 6/2004 | Ebner et al. | |
| 2004/0170781 | A1 | 9/2004 | Sickert et al. | |
| 2005/0089656 | A1 | 4/2005 | Shiina | |
| 2005/0100695 | A1 | 5/2005 | Holbert et al. | |
| 2006/0228552 | A1 * | 10/2006 | Schwantes et al. | 428/402.2 |

FOREIGN PATENT DOCUMENTS

| | | |
|---|---|---|
| WO | WO 2005/051780 | 6/2005 |

OTHER PUBLICATIONS

Technical Specification—Innovia Films, *NatureFlex Data*; Ref. N300—Edition USA.

* cited by examiner

DUAL-OVENABLE CONTAINER FORMED OF A PAPER-BASED LAMINATE

BACKGROUND OF THE INVENTION

The present disclosure relates to dual-ovenable food containers, i.e., containers that can be used both in a conventional oven and in a microwave oven for heating or cooking food contents.

Various types of food products are currently being packaged in containers that are specifically designed to be heated in either a conventional oven or a microwave oven. Some such dual-ovenable containers are formed entirely of polymer material(s). For example, dual-ovenable thermoformed plastic trays are used for some frozen food products that are to be heated or cooked while still in the tray. A membrane lid is sealed to the top surface of the container. Other dual-ovenable containers are formed from composite laminate materials typically including a paperboard layer with one or more polymer layers. In many cases, such dual-ovenable laminate containers are thermoformed or stamped.

While thermoforming or stamping of paper-based laminates is suitable for making some container configurations, it is not suitable for all configurations. Thermoforming or stamping works well when the container is relatively shallow in comparison with its length and width, but can be problematic if the container depth is too great. In the case of containers formed from a paper-based sheet, which is essentially inextensible, the greater the depth of the container for a given diameter, the more wrinkles will be formed in the wall of the container. Such wrinkles can interfere with good sealing between the top of the container body and the lid.

BRIEF SUMMARY OF THE DISCLOSURE

The present disclosure is directed to a dual-ovenable container formed from a blank of laminate material that includes a paperboard layer. The blank is wrapped into a tubular or conical configuration and opposite edges of the blank are overlapped and heat-sealed together to form a container body. End closures can then be applied to the ends of the container body. The laminate must be heat-sealable to itself, must be able to withstand heating/cooking conditions in both conventional and microwave ovens, and must have a low oxygen permeability.

In accordance with one aspect of the present disclosure, the laminate comprises a paperboard layer for structural rigidity and strength, and a pair of heat-sealable cellophane layers laminated to and sandwiching the paperboard layer therebetween and forming the opposite inner and outer surfaces of the container body. In one embodiment, one edge of the blank has a side-seam tape of heat-sealable material wrapped over the edge and heat-sealed to the opposite surfaces of the blank adjacent the edge, in order to seal the edge from exposure to the contents of the container. The edge having the tape is the radially inner edge when the opposite edges of the blank are overlapped and heat-sealed together. Each of the cellophane layers of the blank provides a barrier function such that the laminate has an oxygen permeability not greater than about 1 cc/100 $in^2$/day, more preferably not greater than about 0.5 cc/100 $in^2$/day, and still more preferably not greater than about 0.3 cc/100 $in^2$/day.

In one embodiment, the laminate has the structure A/B/C/B'/A', where A and A' comprise the heat-sealable cellophane layers, C comprises the paper layer, and B and B' comprise adhesive layers. The A and A' layers can be identical to each other, although such is not a necessity. Likewise, the B and B' layers can, but need not, be identical to each other. Advantageously the B and B' layers comprise retortable food-grade adhesive(s). The C layer can comprise a solid bleached sulfate (SBS) board or the like. The sideseam tape can comprise a strip of the A layer material.

Each of the A and A' layers can have the structure a/b/c/b/a, where "a" comprises a heat-seal layer, "b" comprises a tie layer, and "c" comprises a cellulose layer.

In another embodiment, the laminate can have the structure A/B/C/B'/D, where A comprises an amorphous polyester layer, B and B' comprise adhesive layers, C comprises a paperboard layer, and D comprises an oriented polyester layer. The amorphous polyester layer A can comprise amorphous polyethylene terephthalate (APET). The oriented polyester layer D can comprise a coated biaxially oriented PET (BOPET).

The D layer can have the structure a/b, where "a" comprises a heat-seal layer, and "b" comprises a biaxially oriented PET. The D layer can also have the structure a/b/c, where "a" comprises a PVdC (polyvinylidene chloride) coating, "b" comprises a biaxially oriented PET (BOPET) film, and "c" comprises a heat-seal layer. The PVdC-coated BOPET layer provides a barrier function such that the laminate has an oxygen permeability not greater than about 1 cc/100 $in^2$/day, and more preferably not greater than about 0.5 cc/100 $in^2$/day.

In yet a further embodiment, the laminate can have the structure A/B/C/B'/D/A', where A and A' each comprises an amorphous polyester layer, B and B' comprise adhesive layers, C comprises a paperboard layer, and D comprises a barrier-coated polyester layer. The D layer can comprise a PVDC-coated polyester (e.g., PET) layer.

The container bodies formed in accordance with the present disclosure can have various shapes, including cylindrical and non-cylindrical shapes. For example, a cup-shaped container body having a generally conical or other tapered configuration can be formed. There is no particular limit to the depth of the container for a given diameter, and the wall of the container body remains substantially free of wrinkles. This facilitates hermetic sealing between the top of the container body and the lid for the container.

Cup-shaped containers for containing foods (e.g., uncooked cake batter) can be formed in accordance with the present disclosure. The high oxygen barrier performance of the laminate allows the sealed containers to be stored under refrigeration for extended periods of time without significant oxidative degradation of the food.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
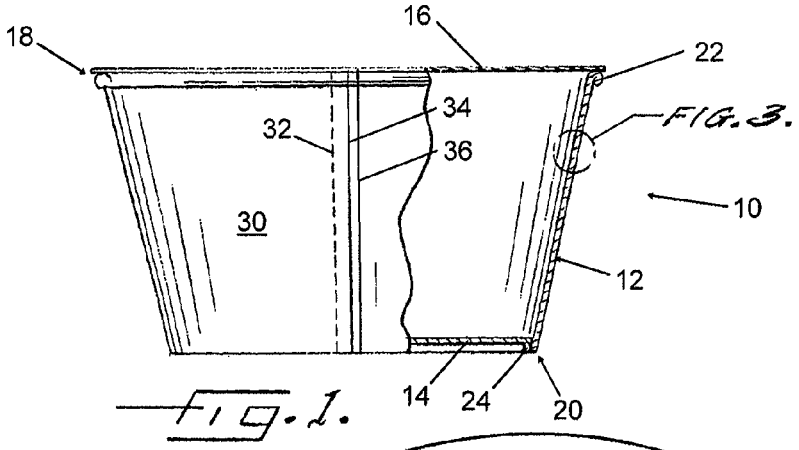
FIG. 1 is a front elevation, partly in section, of a container in accordance with one embodiment of the invention.

A container 10 in accordance with one embodiment of the invention is shown in FIG. 1. The container 10 includes a container body 12, a bottom closure 14, and a membrane lid 16. The container body 12 comprises a generally tubular (e.g., generally cylindrical or generally conical/tapered) structure having a top end 18 and a bottom end 20 each of which is open. The top end 18 can include a rolled rim or bead 22 that provides an annular upper surface for attachment of the lid 16 thereto in order to seal closed the open top end of the container body. The open bottom end 20 of the container body is sealed closed by the bottom closure 14. The bottom closure 14 can be formed as a disk with an outer peripheral skirt 24 of generally cylindrical form depending from the outer edge of the disk. The skirt 24 is attached to the inner surface of the container body 12 adjacent the bottom end thereof to seal the bottom end closed. The side wall of the container body adjacent the bottom end can also be rolled inwardly and upwardly and crimped with the skirt 24, if desired. The partially completed container is then removed from the forming mandrel, filled with the desired contents, and closed by sealing the lid 16 to the upper surface of the bead 22.

Figure 2:
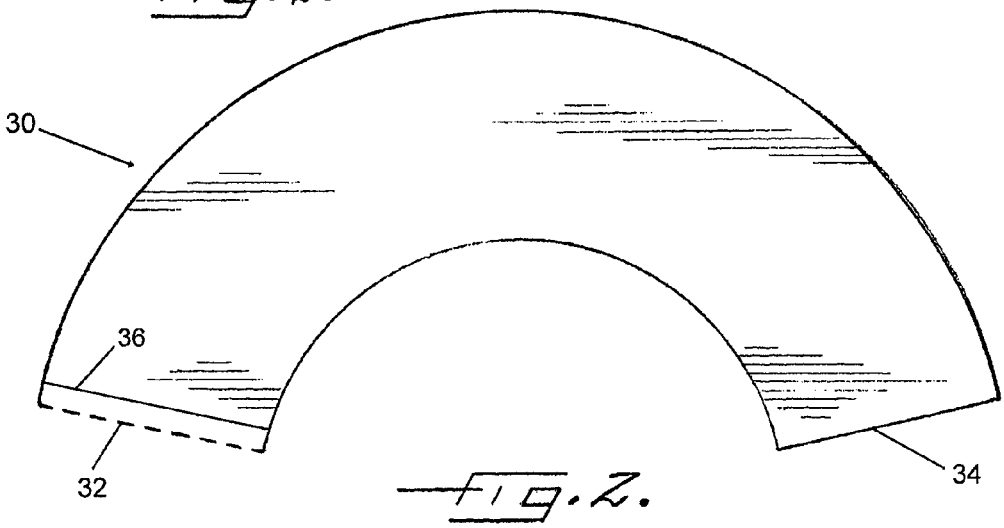
FIG. 2 is a plan view of a blank for constructing a container in accordance with FIG. 1.

In accordance with embodiments of the present invention, and with reference to FIGS. 1 and 2, the container body 12 (and advantageously also the bottom closure 14) is formed from a blank 30 of a laminate material, the blank being wrapped convolutely about an axis into a generally tubular shape with opposite edges 32 and 34 of the blank joined to each other in substantially hermetic fashion to form a longitudinally extending joint along the container body. Such a container body is referred to herein as a "single-wrap" container body. A single-wrap container body typically is formed by wrapping the blank 30 about a forming mandrel (not shown) having the desired cross-sectional shape, joining the edges of the blank together, and then attaching the bottom closure 14 The single-wrap container body can have various configurations (i.e., various diameters, heights, and/or cross-sectional shapes). For example, the cross-sectional shape of the container body can be either round or non-round as desired. The height and diameter of the container body are freely selectable by suitably configuring the blank 30. In the illustrated embodiment, the container 10 has a cup-shaped configuration produced by shaping the container body 12 as a truncated conical configuration.

In embodiments of the invention, the blank 30 comprises a laminate of multiple layers of different materials. In particular, the blank comprises a laminate whose opposite surfaces are formed by a heat-sealable material such that the edges can be overlapped and joined by heat sealing. In the illustrated embodiment, one of the edges is wrapped by a sideseam tape 36 that is heat-sealed to the opposite surfaces of the blank proximate the edge. The tape 36 can comprise any polymer film material that is heat-sealable to the blank 30. For example, the tape can comprise a strip of the same film that is used as one of the outer layers of the blank 30, as further explained below. The tape 36 seals the edge (which otherwise would have exposed paperboard).

The laminate has a low oxygen permeability. By "low oxygen permeability" is meant that the oxygen permeability of the laminate is not greater than about 1 cc/100 $in^2$/day, more particularly not greater than about 0.5 cc/100 $in^2$/day, and still more particularly not greater than about 0.3 cc/100 $in^2$/day. The oxygen permeability is measured according to the standard test procedure ASTM D-3985 entitled "Standard Oxygen Gas Transmission Rate Through Plastic Film and Sheeting Using a Coulometric Sensor".

Another requirement for the container formed by the container body 12 and bottom closure 14 is that it must be dual-ovenable. By "dual-ovenable" is meant that the container is able to withstand exposure to conditions inside a conventional electric or gas oven set at 350° F. for at least 25 minutes without the container losing integrity or substantially degrading, and is also able to withstand exposure to conditions inside a high-powered microwave oven for at least two minutes without the container losing integrity or substantially degrading.

Figure 3:
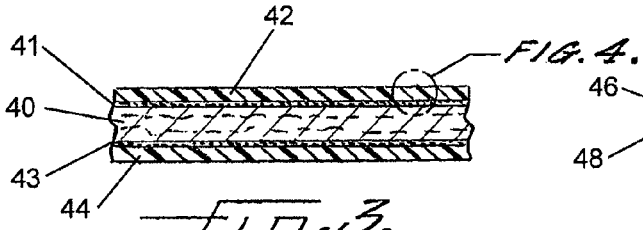
FIG. 3 is a greatly magnified cross-sectional view through the side wall of the container of FIG. 1, in accordance with one embodiment of the invention.

The laminates for forming the blank 30 and bottom closure 14 in accordance with embodiments of the present invention, as described below and illustrated in the drawings, are able to meet the above-described requirements. FIG. 3 illustrates a laminate in accordance with one embodiment of the invention. The laminate comprises a paperboard layer 40 and a pair of heat-sealable cellophane layers 42 and 44 sandwiching the paperboard layer 40 therebetween. An adhesive layer 41 is used for joining the heat-sealable cellophane layer 42 to one side of the paperboard layer 40, and an adhesive layer 43 is used for joining the other heat-sealable cellophane layer 44 to the opposite side of the paperboard layer 40.

The paperboard layer 40 comprises the primary structural member of the laminate, imparting stiffness and strength thereto. The paperboard layer can comprise any of various types of paperboard. An exemplary paperboard suitable for some embodiments of the invention comprises a solid bleached sulfate (SBS) board, but the invention is not limited to any particular paperboard. The thickness of the paperboard layer 40 generally depends upon the requirements of the particular application, and the invention is not limited to any particular thickness or range of thicknesses. An exemplary SBS board suitable for use in some embodiments of the present invention has a thickness or caliper of about 12 points (0.012 inch, or 0.3 mm), but more generally the paperboard layer 40 can have a caliper ranging from about 9 points to about 16 points.

Figure 4:
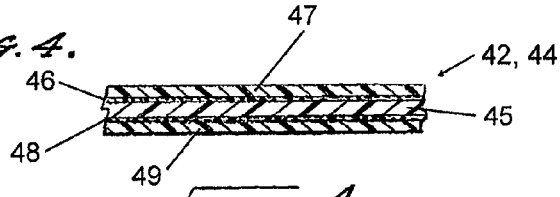
FIG. 4 is cross-sectional view of one of the layers of the side wall of FIG. 3, in accordance with one embodiment of the invention.

The heat-sealable cellophane layers 42, 44 provide oxygen barrier performance for the laminate and also make the laminate's opposite surfaces heat-sealable to each other. Various constructions and materials can be used for the heat-sealable cellophane layers, and the invention is not limited to any particular configuration. An exemplary configuration for the heat-sealable cellophane layers is shown in FIG. 4. Each of these layers comprises a core cellulose layer 45 sandwiched between two heat-seal layers 47 and 49. An adhesive layer 46 can be used for joining the heat-seal layer 47 to one side of the cellulose layer 45, and an adhesive layer 48 can be used for joining the heat-seal layer 49 to the other side of the cellulose layer 45. However, the adhesive layers 46, 48 are optional, and in other embodiments can be omitted.

The cellulose layer 45 can be formed from cellulose fibers derived from wood, cotton, or hemp that are dissolved in alkali to make a viscose solution, which is then extruded through a slit into an acid bath to reconvert the viscose into cellulose. The heat-seal layers 47, 49 comprise a suitable heat-sealable material, advantageously being heat-resistant up to a temperature of about 392° F. for up to 30 minutes. As an example, each of the heat-sealable cellophane layers 42, 44 can comprise NatureFlex NE2 transparent heat-sealable, biodegradable film available from Innovia Films Inc., which has the general construction shown in FIG. 4 and described above.

The adhesive or tie layers 41, 43, 46, 48 used in the laminate of FIG. 3 advantageously comprise "retortable" food-grade laminating adhesives that are able to withstand high temperatures for prolonged periods of time without substantial loss of bonding strength. Suitable retortable food-grade laminating adhesives commercially available for use in the present invention are known to those skilled in the art. The adhesive layers 41 and 43 can comprise the same adhesive material or different adhesive materials, and likewise for the adhesive layers 46 and 48. As an example, the adhesive layer 41 can comprise a blend of TYCEL 7900 and 7283 retortable laminating adhesives available from the Liofol division of Henkel Corporation, applied at a rate of about 2.5 pounds/ream (where a ream is 3000 $ft^2$). TYCEL 7900 is a solvent-based polyurethane adhesive and TYCEL 7283 is a polyol curing agent. The TYCEL 7900 and 7283 adhesives can be blended in proportions of 50 parts of TYCEL 7900 to 1 part of TYCEL 7283, by weight. The adhesive layer 43 can comprise a blend of TYCEL 2780 and 5891 retortable laminating adhesives available from the Liofol division of Henkel Corporation, applied at a rate of about 2.5 pounds/ream. TYCEL 2780 is a solvent-based polyurethane adhesive, and TYCEL 5891 is a curing agent, which can be blended in proportions of 5 parts of TYCEL 2780 to 1 part of TYCEL 5891, by weight.

The laminate of FIG. 3, by virtue of primary ingredients of paper and cellophane, is fully biodegradable. Additionally, the laminate has a low oxygen permeability as defined herein, is dual-ovenable as defined herein, and is heat-sealable. The container 10 of FIG. 1 advantageously can have both the container body 12 and the bottom closure 14 formed from the laminate of FIG. 3. The lid 16 can comprise a different material from the container body and bottom closure. In some embodiments, the lid 16 does not have to be dual-ovenable or able to withstand high temperatures because the lid will be removed before placing the container into an oven. For example, the container 10 can be used for containing uncooked cake batter that is to be baked to make a cupcake or muffin. The cake batter is sealed within the container by the lid, and thus is protected from the outside environment during storage of the container prior to baking. When it is desired to bake the cake batter, the lid is peeled off and discarded, and the container is placed into the oven for the requisite amount of time.

Figure 5:
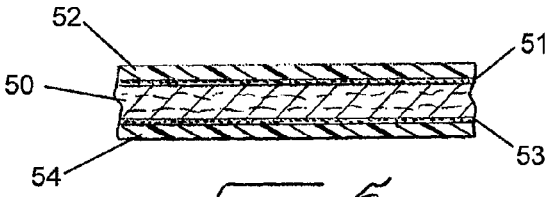
FIG. 5 is a view similar to FIG. 3, showing a second embodiment of the invention.

A laminate in accordance with another embodiment of the invention is depicted in FIG. 5. The laminate comprises a paperboard layer 50, an amorphous polyester layer 52 laminated to one side of the paperboard layer via an adhesive layer 51, and a PVdC-coated oriented polyester layer 54 laminated to the other side of the paperboard layer via an adhesive layer 53. The adhesive layers 51, 53 can comprise the same or different retortable food-grade laminating adhesive materials. The paperboard layer 50 can comprise the same material and have the same characteristics as the paperboard layer 40 of the prior embodiment. The amorphous polyester layer 52 can comprise amorphous polyethylene terephthalate (APET). The oriented polyester layer 54 can comprise a PVdC-coated biaxially oriented PET (BOPET), such as MYLAR® available from Dupont. As an example, the laminate can comprise a 1 mil (0.0254 mm) APET layer 52, a 12.3 point (0.3 mm) SBS board 50, and a 100 gauge (0.0254 mm) BOPET layer 54. The PVdC-coated BOPET layer 54 can comprise a Dupont MYLAR® OB12 film.

The adhesive layer 51 can comprise a blend of TYCEL 7900 and 7283 retortable laminating adhesives available from the Liofol division of Henkel Corporation, applied at a rate of about 2.5 pounds/ream. The TYCEL 7900 and 7283 adhesives can be blended in the same proportions indicated above for the adhesive layer 41. The adhesive layer 53 can comprise a blend of TYCEL 2780 and 5891 retortable laminating adhesives available from the Liofol division of Henkel Corporation, applied at a rate of about 2.5 pounds/ream, blended in the same proportions indicated above for the adhesive layer 43.

Figure 6:
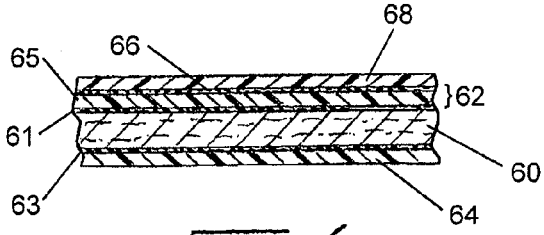
FIG. 6 is a view similar to FIG. 3, showing a third embodiment of the invention.

A laminate in accordance with a further embodiment of the invention is shown in FIG. 6. The laminate includes a paperboard layer 60 having the same characteristics as those previously described for the prior embodiments. A barrier-coated polyester layer 62 is laminated to one side of the paperboard layer via a retortable food-grade laminating adhesive 61. The barrier-coated polyester layer 62 includes a polyester layer 65 having a coating 66 of a material that has good oxygen barrier performance. The polyester layer 65 can comprise PET. The barrier coating 66 can comprise PVdC or ethyl vinyl alcohol (EVOH). An amorphous polyester layer 64 is laminated to the opposite side of the paperboard layer 60 via a retortable food-grade laminating adhesive 63. A second amorphous polyester layer 68 is joined to the opposite side of the barrier-coated polyester layer 62. The amorphous polyester layers 64 and 68 can comprise APET.

As an example, the laminate of FIG. 6 can comprise a 1 mil (0.0254 mm) APET film 64, a 12.3 point (0.3 mm) SBS layer 60, a 38 gauge (0.00965 mm) PVDC-coated PET layer 62, and a 2 mil (0.05 mm) PET layer 68. The PVDC-coated PET layer can comprise a 22.00 PVdC-coated PET film available from Terphane Inc. of Bloomfield, N.Y. The adhesive layers 61, 63 can comprise the same blends of TYCEL adhesives described for the prior embodiments.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dual-ovenable container, comprising:

a container body formed by a blank wrapped about an axis into a generally tubular or conical configuration with opposite edges of the blank overlapped and joined together by heat sealing to form a lap joint, the blank comprising a laminate that comprises at least:

a paperboard layer for structural rigidity and strength; and a pair of heat-sealable cellophane layers laminated to and sandwiching the paperboard layer therebetween and forming the opposite inner and outer surfaces of the container body;

wherein the laminate has the structure A/B/C/B'/A', where A and A' comprise the heat-sealable cellophane layers, C comprises the paperboard layer, and B and B' comprise adhesive layers, and wherein A and A' each has the structure a/b/c/b/a, where "a" comprises a heat-seal layer, "b" comprises a tie layer, and "c" comprises a cellulose layer.

2. The dual-ovenable container of claim 1, wherein each of the cellophane layers provides an oxygen barrier function such that the laminate has an oxygen permeability not greater than about 0.5 cc/100 $in^2$/day.

3. The dual-ovenable container of claim 1, wherein A and A' are identical to each other.

4. The dual-ovenable container of claim 1, wherein B and B' are identical to each other.

5. The dual-ovenable container of claim 1, wherein B and B' are retortable adhesives.

6. The dual-ovenable container of claim 2, wherein the laminate has an oxygen permeability not greater than about 0.3 cc/100 $in^2$/day.

7. The dual-ovenable container of claim 1, wherein one of the opposite edges of the blank that is exposed to contents of the container is wrapped by a sideseam tape formed separately from the blank and heat-sealed to opposite surfaces of the blank proximate the edge, the sideseam tape protecting the edge of the blank from the contents of the container.

8. The dual-ovenable container of claim 1, further comprising a bottom wall affixed to the container body, the bottom wall being formed of the same laminate as the container body.

* * * * *

UNITED STATES PATENT AND TRADEMARK OFFICE

CERTIFICATE OF CORRECTION

PATENT NO. : 8,002,170 B2
APPLICATION NO. : 12/179626
DATED : August 23, 2011
INVENTOR(S) : Dixon-Garrett et al.

It is certified that error appears in the above-identified patent and that said Letters Patent is hereby corrected as shown below:

Column 1,
Line 65, “the paper layer” should read --the paperboard layer--.

Signed and Sealed this
Eleventh Day of September, 2012

David J. Kappos

David J. Kappos
*Director of the United States Patent and Trademark Office*